US007789280B1

(12) United States Patent
Gouelibo et al.

(10) Patent No.: US 7,789,280 B1
(45) Date of Patent: Sep. 7, 2010

(54) SEMI-AUTOMATIC APPARATUS FOR AFFIXING ANTI-THEFT DEVICE TO AN ARTICLE

(75) Inventors: Didier Gouelibo, Cernay-la-Ville (FR); Alain Dameme, Neauphle-le-chateau (FR)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 09/381,752

(22) PCT Filed: Mar. 24, 1998 (Under 37 CFR 1.47)

(86) PCT No.: PCT/US98/05909

§ 371 (c)(1), (2), (4) Date: Sep. 22, 1999

(87) PCT Pub. No.: WO98/43781

PCT Pub. Date: Oct. 8, 1998

(30) Foreign Application Priority Data

Mar. 28, 1997 (FR) ..... 97 03847

(51) Int. Cl.
*B25C 1/04* (2006.01)
*A41H 37/02* (2006.01)

(52) U.S. Cl. ..... 227/18; 227/67; 227/119; 227/137; 292/307 R

(58) Field of Classification Search ..... 227/2, 227/18, 15, 67, 107, 119, 130, 135, 137, 227/156; 292/307 R, 318
See application file for complete search history.

(56) References Cited

U.S. PATENT DOCUMENTS

| | | | | |
|---|---|---|---|---|
| 4,090,652 | A * | 5/1978 | Silverbush | 227/18 |
| 4,536,933 | A * | 8/1985 | Furutsu | 29/235 |
| 4,588,218 | A * | 5/1986 | Guiler et al. | 292/307 R |
| 4,605,150 | A * | 8/1986 | Ikehara | 227/18 |
| 5,775,566 | A * | 7/1998 | Kochs et al. | 227/18 |

* cited by examiner

*Primary Examiner*—Scott A. Smith

(57) ABSTRACT

A semi-automatic machine for affixing an anti-theft device, such as an EAS marker, to an article of clothing or the like. The anti-theft device is of the type made up of two elements that are to be snapped together through the article of clothing. Each of the two kinds of elements is stored in a respective vibrating bowl and transferred to an assembly station by a respective vibrating conveyor. One of the two elements is positioned on a working surface at the assembly station. The second element is taken up by a snap-connection mechanism. A laser provides a reference mark at the working surface so that an operator can precisely position a desired part of the article of clothing for receiving the anti-theft device. After the article is positioned in accordance with the reference mark, the snap-connection mechanism is actuated to insert the second element into the first element through the article of clothing.

11 Claims, 2 Drawing Sheets

SEMI-AUTOMATIC APPARATUS FOR AFFIXING ANTI-THEFT DEVICE TO AN ARTICLE

BACKGROUND OF THE INVENTION

The present invention is generally concerned with the field of electronic article surveillance (EAS), and more specifically relates to a semi-automatic machine for affixing an anti-theft device (i.e., an EAS marker) to an article of merchandise, and particularly an article formed of fabric, offered for sale in a self-service store or stocked in a warehouse.

A known method of combating theft is to affix anti-theft devices to articles of merchandise and to equip retail stores and/or warehouses with systems for detecting these anti-theft devices. Thus, if a customer who has picked up an article from the shelf of a self-service store, for example, intentionally or accidentally fails to present the article at the cash register before leaving the store, the anti-theft device affixed to that article will automatically trip an alarm as the customer passes through a detection system situated at the exit from the store.

When the articles to be protected are made of fabric, in particular in the case of garments, the anti-theft device used generally comprises two elements that are assembled together by snap connection through the fabric. The assembly is designed such that the customer himself or herself cannot separate the two elements of the anti-theft device. On presentation at the cash register, the cashier neutralizes the anti-theft device by removing it from the garment with appropriate tools.

The two elements of an anti-theft device generally comprise a rigid label which includes a recessed hole and a pin formed of a head and a thin, pointed member. The operation of assembling the label and pin is typically performed manually by an operator. To do so, the operator must hold a label, a pin and the fabric at the same time, then pierce the fabric with the point of the pin to engage it in the hole of the label, such assembly being performed at a roughly defined place on the fabric that does not have any particular reference mark.

OBJECTS AND SUMMARY OF THE INVENTION

An object of the invention is to provide a semi-automatic machine to facilitate the aforesaid assembly operations and to perform them in a reliable and precise manner.

To this end, the invention provides a semi-automatic apparatus for affixing an anti-theft device (i.e., an EAS marker) to an article, the anti-theft device comprising two elements designed to be assembled together by snap connection through the article, the apparatus comprising:

- two separate devices for respectively storing and transferring seriatim the first and the second elements of the anti-theft devices to an assembly station, and
- an assembly station comprising a working surface, a device for positioning the first element of an anti-theft device in an assembly position on the working surface, a manipulating device for bringing the second element of the anti-theft device into an assembly position situated above the first element, a sighting device to permit an operator to position the article on the working surface in such a way that the snap connection of the two elements is made at a desired place on the article, and a device for automatic snap connection of the two elements through the article and at the desired place.

In general, the two devices for storage and transfer of the elements of the anti-theft devices are vibratory devices that allow the said elements to be moved automatically to the assembly station.

Each device for storage and transfer of the anti-theft devices comprises in particular a vibrating retrieval and sorting bowl provided with a circular convex bottom in order that the received elements naturally become positioned at the circumference of the bottom of the bowl, the inside wall of the bowl being flared and also provided with a helicoidal ramp that forms a guide path between the bottom and the upper part of the bowl, and a conveyor comprising a guide rail, one end of which connects at the level of the upper end of the helicoidal ramp of the vibrating bowl and the other end of which discharges at the level of the assembly station.

In general, the sighting device situated at the assembly station comprises a light source that projects a beam onto the working surface to mark the place where the two elements of an anti-theft device will be assembled by snap connection, this beam being projected onto the article to form a light spot or reference mark directly on the article when the operator positions the article on the working surface.

According to one advantage of the machine according to the invention, the anti-theft devices are assembled automatically and precisely on the articles to be protected.

According to another advantage of the machine according to the invention, the operator no longer has to manipulate the elements of the anti-theft devices, the only operation to be performed by hand being limited to positioning the article relative to the reference mark projected by the light source onto the article.

According to yet another advantage of the machine according to the invention, the anti-theft devices are affixed to the articles at higher speed without placing undue stress on the operator.

The machine is used for fabric articles such as items of clothing and, in general, for any article whose material can be perforated by a pointed object without risk of damage to the article. In particular, the article may be of leather, although the precaution is then taken of assembling the anti-theft device at the position of a seam, which is possible by virtue of the precision of the apparatus.

In general, the apparatus according to the invention can be of space-saving construction, and may advantageously be mounted on a cart so that the assembly station can be moved to any desired location, since the apparatus can be designed to operate from a simple electrical outlet.

Other advantages and features of the invention will become evident from the description provided hereinafter with reference to the attached drawings.

DESCRIPTION OF PREFERRED EMBODIMENTS

Figure 1:
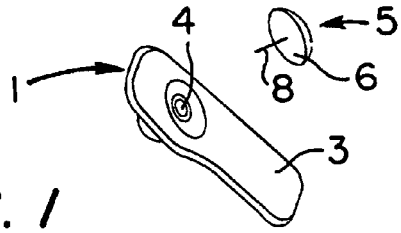
FIG. 1 is a perspective view of a conventional anti-theft device used for fabric articles and comprising a rigid label and a pin.

The anti-theft devices to be employed according to the invention comprise two elements assembled together by snap connection. The anti-theft device 1 illustrated in FIG. 1 comprises a rigid label 3 pierced by a recessed hole 4, and a pin 5, which includes a head 6 fitted to a pointed member 8. When the anti-theft device 1 is to be assembled, pointed member 8 of pin 5 is engaged in recessed hole 4 of label 3.

Figure 2:
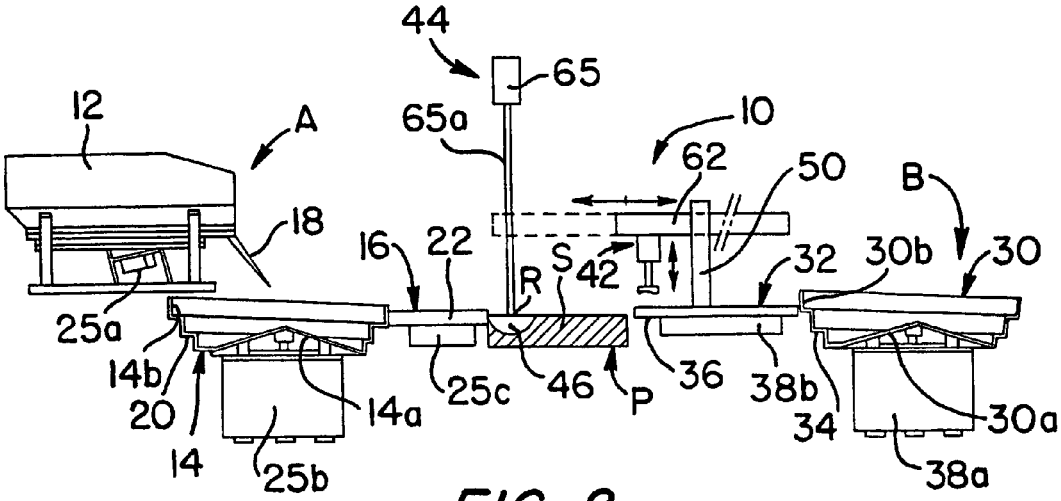
FIG. 2 is a schematic view of an anti-theft device affixing apparatus provided according to the invention.

A semi-automatic apparatus 10 for affixing an anti-theft device 1 to an article to be protected is illustrated schematically in FIG. 2. The apparatus 10 includes subassemblies A and B which respectively store and transfer labels 3 and pins 5 to an assembly station P.

Subassembly A includes a storage hopper 12, a retrieval and sorting bowl 14 and a conveyor 16.

Hopper 12 is provided with an outlet chute 18 that discharges the labels 3 above retrieval and sorting bowl 14. The labels 3 are stored in bulk in hopper 12 and are dispensed from the hopper 12 via outlet chute 18 and fall by gravity into the bottom of bowl 14.

Retrieval and sorting bowl 14 is provided with a bottom 14*a* of circular and convex shape, so that labels 3 naturally become positioned at the circumference of bottom 14*a*. The inside wall 14*b* of bowl 14 is flared and provided with a helicoidal ramp 20 which forms a guide path between bottom 14*a* and the upper part of bowl 14. Ramp 20 is slightly inclined in such a manner that its inside edge is higher than its outside edge, which is in contact with the inside wall 14*b* of bowl 14.

Conveyor 16 includes a guide track 22, one end of which is adjacent to the upper end of helicoidal ramp 20 and the other end of which is adjacent to the assembly station P.

In general, the movement of labels 3 from storage hopper 12 to assembly station P is ensured by appropriate triaxial vibrational excitation of hopper 12, to direct labels 3 toward outlet chute 18, retrieval and sorting bowl 14, to force labels 3 to exit bowl 14 by ascending one after the other along helicoidal ramp 20, and conveyor 16, to direct labels 3 to working station P.

To this end, three vibratory devices 25*a*, 25*b* and 25*c* are associated respectively with hopper 12, bowl 14 and conveyor 16.

Subassembly B comprises a sorting and retrieval bowl 30 and a conveyor 32. Pins 5 of the anti-theft devices are directly stored in bulk in bowl 30. Pins 5 have smaller dimensions than labels 3, and it is therefore not necessary to provide a storage hopper upstream from bowl 30. In general, bowl 30 has a structure similar to that of bowl 14 for retrieval of labels 3. That is, bowl 30 includes a bottom 30*a* of circular and convex shape, and a flared inside wall 30*b* provided with a helicoidal ramp 34 forming a guide path between bottom 30*a* and the upper part of bowl 30.

Conveyor 32 comprises a guide track 36, one end of which is adjacent to the upper end of helicoidal ramp 34 and the other end of which is adjacent to assembly station P.

Figure 4:
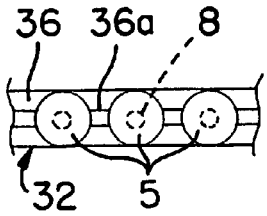
FIG. 4 is a schematic plan view of a device, included in the apparatus of FIG. 1, for transferring pins to the assembly station.

Advantageously, track 36 is provided with a central slit 36*a*, in which the pointed member 8 of each pin 5 becomes freely engaged (FIG. 4).

The movement of pins 5 from the bottom of bowl 30 to assembly station P is ensured by causing vibration of bowl 30 in order to force pins 5 to leave the bowl by ascending one after the other along the helicoidal ramp 34, and of conveyor 32 in order to transport pins 5 to assembly station P. To this end, two vibratory devices 38*a* and 38*b* respectively are associated with bowl 30 and conveyor 32.

Assembly station P comprises a working surface S, a device 40 for positioning labels 3 on working surface S, a device 42 for manipulating pins 5, a sighting device 44 to permit an operator to position correctly on working surface S the place of the fabric at which an anti-theft device 1 is to be affixed by snap connection, and a device for automatic snap connection of a label 3 and a pin 5.

Figure 3:
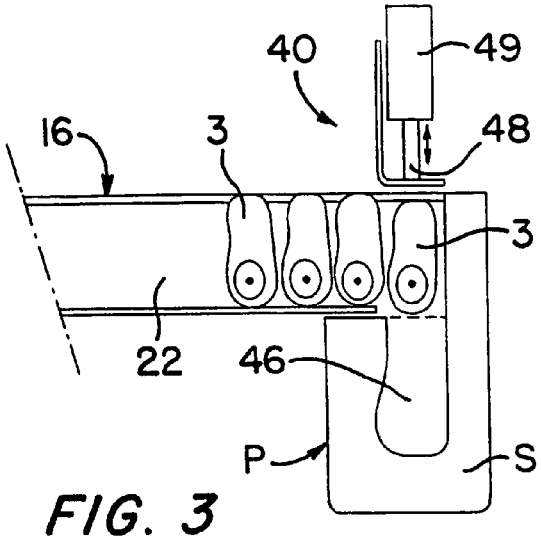
FIG. 3 is a schematic plan view of a device, included in the apparatus of FIG. 1, for transferring rigid labels to an assembly station.
Figure 5:
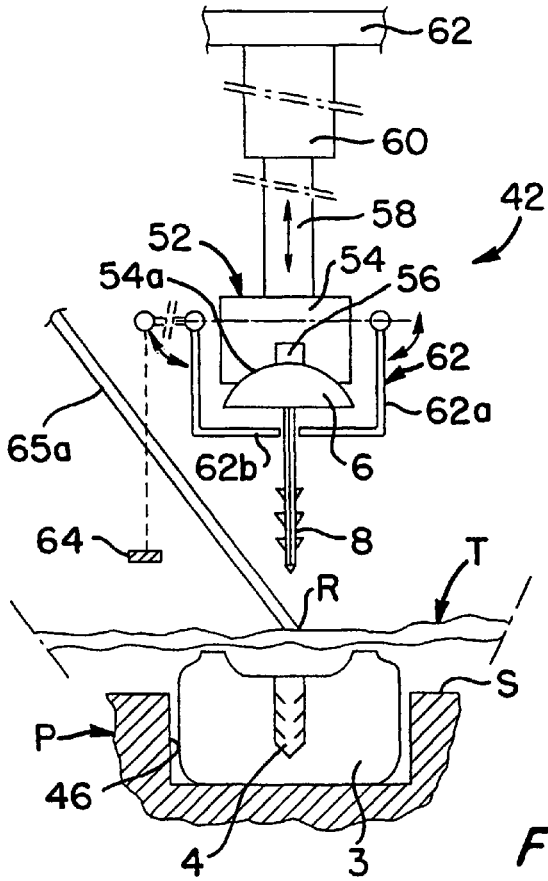
FIG. 5 is a schematic view which illustrates operation of an affixing apparatus according to a first embodiment of the invention.

A first embodiment of the invention will now be described with reference to FIGS. 2, 3 and 5.

Device 40 for positioning labels 3 (FIG. 3) includes an impression 46 formed on working surface S and having a shape complementary to that of a label 3, and a pushing device, including a shaft 48 of a piston 49, for example.

The downstream end of conveyor 16 is adjacent to the level of working surface S, and shaft 48 of piston 49 is transversely movable relative to conveyor 16 in such a manner that it pushes label 3 situated at the downstream end of conveyor 16 into impression 46, where label 3 is immobilized in its assembly position.

Device 42 for manipulating pins 5 (FIG. 2) is mounted on a fixed support 50 rising above working surface S. Manipulating device 42 (FIG. 5) includes a gripping device 52 which comprises a head 54, one end-face 54*a* of which has hemispherical shape in order to accommodate the shape of head 6 of a pin 5 and holds such pin by means, for example, of a magnet 56. The other end-face of head 54 is integral with the end of a shaft 58 of a piston 60, which extends perpendicularly to working surface S.

Piston 60 is fixed on an arm 62 mounted movably on fixed support 50 in order to move gripping device 52 between two positions, namely, a first position situated vertically above the downstream end of conveyor 32 in order to pick up a pin 5, and a second position situated vertically above label 3 lodged in impression 46 of working surface S. To perfect the alignment between pointed member 8 of a pin 5 picked up by gripping device 52 and recessed hole 4 of label 3 situated in impression 46, there is provided a pincer 63. The two arms 63*a* and 63*b* of pincer 63 are pivotally mounted on head 54 so that they can close on both sides of pointed member 8 of pin 5. Pincer 63 cooperates with a fixed cam 64, as will be explained hereinafter.

Sighting device 44 (FIG. 2) is provided to project upon working surface S a reference mark R indicating the place where label 3 and a pin 5 will be assembled. Sighting device 44 comprises a laser source 65, which projects a light beam 65*a* that will produce the reference mark R in the form of a light spot situated on hole 4 of label 3 positioned in impression 46.

The snap-connection device comprises shaft 58 of piston 60 of manipulating device 42 in order to make pointed member 8 of pin 5 penetrate into recessed hole 4 of label 3.

During operation of this first embodiment, an operator urges, by means, for example, of a first pedal (not shown), piston 49 of device 40 for positioning labels 3 in such a way that the shaft 48 of piston 49 pushes label 3 situated at the downstream end of conveyor 16 into impression 46 of working surface S. The operator then urges, by means, for example, of a second pedal (not shown), piston 60 of manipulating device 42 in such a way that head 54 of gripping device 52 descends into contact with pin 5 situated at the downstream end of conveyor 32 in order to pick up pin 5 by means of magnet 56. Head 54 is raised, the two arms 62*a* and 62*b* of pincer 62 close on both sides of pointed member 8 of pin 5, and movable arm 62 is moved in such a way that it positions pin 5 vertically above label 3 situated in impression 46. The operator then places article T on working surface S by positioning the place where anti-theft device 1 must be affixed on reference mark R projected by light beam 65*a* onto article T. Once such positioning has been completed, the operator urges, by means, for example, of a third pedal (not shown), piston 60 in such a way that it lowers pin 5 toward label 3 lodged in impression 46, and causes pointed member 8 to penetrate into recessed hole 4. As soon as pointed member 8 has passed through article T and penetrates into hole 4, the two arms 62*a* and 62*b* of pincer 62 open by coming into contact with cam 64, thus releasing pin 5 and allowing it to become engaged more deeply in hole 4.

Figure 6:
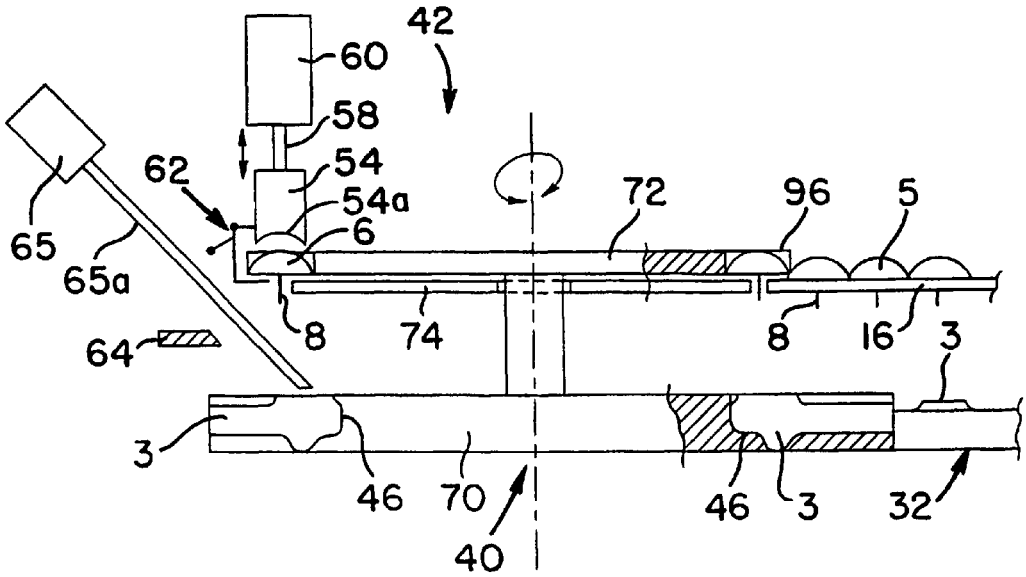
FIG. 6 is a schematic view which illustrates operation of an affixing apparatus according to a second embodiment of the invention.

According to a second embodiment illustrated in FIG. 6, device 40 for positioning labels 3 comprises a circular turntable 70 which possesses, for example, two diametrically opposite impressions 46 on its circumference. Each impression 46 has a shape complementary to that of labels 3. Table 70 is rotated in steps of 180° in such a way as to position one impression 46 in the extension of the downstream end of conveyor 22 and to permit a label 3 to become lodged in this impression 46, while the opposite impression is situated facing the place where assembly will be performed.

Device 42 for manipulating pins 5 comprises a circular table 72 coaxial with table 70, connected to rotate therewith and situated thereabove. Table 72 possesses on its circumference two notches 96, which are diametrically opposite and situated at right angles to impressions 46 of table 70. The downstream end of conveyor 32 discharges facing table 72 in order to permit a pin 5 to be positioned freely in one of the notches 96 of table 72.

Each pin 5 is held in position by means of a semicircular fixed table 74, which is coaxial with movable tables 70 and 72 and is situated underneath table 72 in order to retain head 6 of pin 5 during rotation of disk 72.

The device for automatic snap connection of a pin 5 and a label 3 is similar to that described with reference to the first embodiment.

During operation of this second embodiment, an operator urges, by means, for example, of a first pedal (not shown), simultaneous rotation of the two tables 70 and 72 by one half rotation in order to bring a label 3 and a pin 5 into alignment with piston 60 of the snap-connection device. When pin 5 arrives in this alignment, it is no longer supported by fixed table 74 but instead is supported by the two arms 62*a* and 62*b* of pincer 62. The operator then places article T on working surface S by positioning the place where anti-theft device 1 must be affixed on reference mark R projected onto article T. Once such positioning has been completed, the operator urges, by means, for example, of a second pedal, piston 60 in such a way that it lowers pin 5 toward label 3 and causes pointed member 8 to penetrate into recessed hole 4. As soon as pointed member 8 has passed through article T and penetrates into hole 4, the two arms 62*a* and 62*b* of pincer 62 open by coming into contact with cam 64, thus releasing pin 5 and allowing it to become engaged more deeply in hole 4

It will be understood that the number of impressions and notches 96 provided respectively in tables 70 and 72 can be greater than two.

In general, vibrating bowls 14 and 30 are bowls for retrieval of labels 3 and pins 5, but they also perform a sorting function by means of helicoidal ramps 20 and 34, which are designed such that they prevent ascent of an element having a shape other than that of a label 3 or of a pin 5 that may stray by error into the bottom of these bowls. To this end, ramps 20 and 34 are provided with guide elements that are appropriate to cause extraneous elements to fall back inside the bowls.

The anti-theft device 1 shown herein for attachment to articles by the apparatus 10 is of the type known as an EAS marker, but it should be understood that an apparatus like apparatus 10 could be provided to attach to articles of clothing, etc., other types of anti-theft devices such as ink tags.

What is claimed is:

1. An apparatus for affixing an anti-theft device to an article of merchandise, the anti-theft device comprising a first element and a second element, the first and second elements adapted for assembly together by snap connection through the article of merchandise, the apparatus comprising:

an assembly station which includes a working surface;

first means for storing a plurality of said first elements and for transferring stored first elements seriatim to said assembly station; and second means for storing a plurality of said second elements and for transferring stored second elements seriatim to said assembly station;

said assembly station further including:

positioning means for positioning one of said first elements transferred to said assembly station by said first means at a first assembly position on said working surface;

manipulating means for positioning one of said second elements transferred to said assembly station by said second means at a second assembly position above said first assembly position;

sighting means for guiding an operator to position the article of merchandise at a desired location relative to said first assembly position; and connection means for snap connecting at said desired location said first element at said first assembly position and said second element of said second assembly position.

2. An apparatus according to claim 1, wherein:

said first means includes first vibration means for vibrating said first means; and said second means includes second vibration means for vibrating said second means.

3. An apparatus according to claim 2, wherein:

said first means includes a first bowl in which said first elements are stored, said first bowl having a circular, convex bottom for positioning said first elements at the circumference of the bottom, and a flared inside wall with a first helicoidal ramp for forming a guide path for guiding said first elements from the bottom of said first bowl to an upper part of said first bowl; said first means also including a first vibrating conveyor for receiving first elements discharged from said first helicoidal ramp and transferring the first elements to the working surface; and said second means includes a second bowl in which said second elements are stored, said second bowl having a circular, convex bottom for positioning said second elements at the circumference of the bottom, and a flared inside wall with a second helicoidal ramp for forming a guide path for guiding said second elements from the bottom of the second bowl to an upper part of said second bowl; said second means also including a second vibrating conveyor for receiving second elements discharged from said second helicoidal ramp and transferring said second elements to said manipulating means.

4. An apparatus according to claim 3, wherein:

said first helicoidal ramp includes means for preventing any item other than said first elements from ascending to the upper part of said first bowl; and said second helicoidal ramp includes means for preventing any item other than said second elements from ascending to the upper part of said second bowl.

5. An apparatus according to claim 3, wherein said positioning means includes at least one impression formed in said working surface and having a shape complementary to a shape of the first elements to hold one of the first elements at said first assembly position, and pushing means for pushing a first element situated at a downstream end of the first conveyor into the impression.

6. An apparatus according to claim 3, wherein the manipulating means includes gripping means for gripping a second element situated at a downstream end of the second conveyor, said gripping means including a movable head having a first end face which has a shape complementary to a shape of said second elements, said gripping means also including a magnet for retaining a second element at said first end face of said movable head, said manipulating means also including a piston having a shaft which is integral with a second end face of said movable head, said piston also constituting said connection means.

7. An apparatus according to claim 6, wherein said manipulating means also includes a movable arm supported for horizontal movement relative to a fixed surface positioned above said working surface, said gripping means being mounted on said movable arm for movement between a position directly above said downstream end of said second conveyor and said second assembly position.

8. An apparatus according to claim 3, wherein:

said positioning means includes a first turntable having formed therein at least one impression having a shape complementary to a shape of the first elements for receiving a first element discharged from said first conveyor means; and said manipulating means includes a second turntable coaxial with said first turntable and having at least one notch for receiving a second element discharged from said second conveyor means.

9. An apparatus according to claim 3, wherein said first means also includes:

a hopper for storing quantities of said first elements; and means for dispensing first elements from said hopper to said first bowl.

10. An apparatus according to claim 1, wherein said sighting means includes a laser source for projecting a light beam to form a reference mark on said working surface.

11. An apparatus according to claim 1, wherein the first element is a rigid label having a recessed hole, and said second element is a pin having a pointed member adapted to be engaged by said recessed hole.

* * * * *